US005206642A

United States Patent [19]

Gregoire et al.

[11] Patent Number: 5,206,642

[45] Date of Patent: Apr. 27, 1993

[54] DEVICE FOR DETECTING DATA RELATING TO THE PASSAGE OF VEHICLES ON A ROAD

[75] Inventors: Pierre Gregoire, Lagny; Gilles Bailleul, Montesson, both of France

[73] Assignee: U.S. Philips Corporation, New York, N.Y.

[21] Appl. No.: 693,738

[22] Filed: Apr. 30, 1991

[30] Foreign Application Priority Data

May 11, 1990 [FR] France ..... 90 05918

[51] Int. Cl.[5] ..... G08G 1/01

[52] U.S. Cl. ..... 340/933; 174/110 A; 174/118; 340/941

[58] Field of Search ..... 340/933, 941, 936, 939; 174/258, 77 R, 110 R, 110 A, 118; 73/146, DIG. 4; 364/436–438; 404/9, 11, 71, 72, 75

[56] References Cited

U.S. PATENT DOCUMENTS

| | | | |
|---|---|---|---|
| 2,785,218 | 3/1957 | Kirch | 174/110 R |
| 3,789,130 | 1/1974 | Parker | 174/118 |
| 4,943,805 | 7/1990 | Dennison | 340/933 |
| 5,008,666 | 4/1991 | Gebert et al. | 340/933 |

FOREIGN PATENT DOCUMENTS

| | | | |
|---|---|---|---|
| 0384874 | 8/1990 | European Pat. Off. . | |
| 2482340 | 11/1981 | France | 340/933 |
| 0568064 | 8/1977 | U.S.S.R. | 340/941 |
| 0691659 | 5/1953 | United Kingdom | 174/118 |

OTHER PUBLICATIONS

P. Coville, Cables piezo-electriques: de nombreuses possibilites en mesure, Mar. 15, 1982, pp. 73–75.

Harry L. Trietley, Need a T/C or RTD in a hurry?, I&CS-The Industrial and Process Control Magazine, Jul. 1983, pp. 43–44.

*Primary Examiner*—Jin F. Ng
*Assistant Examiner*—Brent A. Swarthout
*Attorney, Agent, or Firm*—Paul R. Miller

[57] ABSTRACT

A device for detecting data relating to the passage of vehicles on the road including a piezoelectric effect cable and a cylindrical metal tube having an inside diameter which is larger than the outside diameter of the piezoelectric cable with the space between the cable and inner walls of the tube being filled with a compacted metal oxide power.

6 Claims, 2 Drawing Sheets

DEVICE FOR DETECTING DATA RELATING TO THE PASSAGE OF VEHICLES ON A ROAD

BACKGROUND OF THE INVENTION

The invention relates to a device for detecting data relating to the passage of vehicles on a road, said device comprising a piezoelectric cable and means making the cable rigid and of transmitting loads produced by passing vehicles to said cable.

The invention is used for detecting the passage of vehicles, counting their numbers, measuring the speed and the weight of the vehicles and their classification in regions having different and, in particular, rigorous climatic conditions (a very hot, moderate or very cold climate).

In French Patent Specification FR 2 482 340 a description is given of a device for detecting the passage on a road. Further, it describes how it is installed and how it is used to measure speed.

Said device comprises, inter alia, a cable with a piezoelectric effect. This cable is a coaxial armoured cable the core and the cladding of which are separated by a piezoelectric ceramic.

Said device further comprises a rigid section having a U-shape or the shape of a rectangular quadrangle with a convex upper surface. Said section is filled on the inside with a synthetic resin material which is hardened by polymerization. The aim is to provide a rigid device.

In another version, the device is surrounded, at the three faces which are not in contact with the vehicles, with a U-shaped, flexible or hard synthetic resin envelope of, for example, a resin which is filled with an elastomer to absorb vibrations. This is a factory-made construction.

In either case, the installation of the device in the road surface requires the formation of a groove in the road, the dimensions of the groove being slightly larger than the dimensions of the device. Subsequently, the bottom and the sides of the groove are coated with a shock-absorbing, flexible synthetic resin material and, finally, the device is fixedly arranged in the coated groove while projecting slightly from the surface of the road. The coating of the groove can be dispensed with because the device is manufactured with a synthetic resin envelope.

To measure speed, two devices may be manufactured constituting two rigid, parallel limbs which are spaced at a predetermined, fixed distance from each other and arranged in two grooves in the road.

A disadvantage of the above-mentioned device according to the state of the art is that its manufacture requires the use of synthetic resin materials which are organic materials and which are very sensitive to variations in temperature.

SUMMARY OF THE INVENTION

It is an object of the invention to measure the speed of vehicles and, besides the counting of the number of vehicles, to detect the weight of moving vehicles and their classification. The detection and analysis of said data are particularly important with respect to the planning of new roads, bridges and streets as well as for the planning of the maintainance thereof.

When organic materials are used for the manufacture of the detection devices, the measurements are not reliable as regards detecting the weight of the vehicles because said measurements depend on climatic conditions. The measurements may be non-reproducible or measuring may even be impossible in regions with rigorous climatic conditions.

Besides, when it is necessary to also use a synthetic resin material to fix the device in the road, the use of the device in regions having rigorous climatic conditions will meet with difficulties or will be found to be impossible.

It is an object of the invention to provide a device for detecting data relating to the passage of vehicles on a road, such as detecting passing vehicles and measuring their speed, as is done by the device according to the state of the art, but also to detect, notably, data relating to the weight of moving vehicles so that said vehicles can be classified.

This problem can be solved by abandoning the use of organic materials, both in the manufacture of the detection device and in the process of installing it in the road.

In accordance with the invention, this object is achieved by means of a device which is characterized in that it comprises a cylindrical metal tube having a diameter which is larger than that of the piezoelectric cable which is arranged along the axis of the tube, the space between the cable and the inner walls of the tube being filled with a compacted metal oxide powder.

The advantage of this device is that the rigid envelope is no longer a section but a tube which can be produced more easily and at a lower cost in an industrial manufacturing process.

Another advantage is that the compacted metal oxide powder satisfactorily transmits the desired information to the piezoelectric cable and that it is much less sensitive to climatic conditions than synthetic resin material.

A further advantage is that the device according to the invention has a longer life cycle because it is mechanically almost insensitive to climatic conditions and much less sensitive to mechanical degradation.

Besides, it can be manufactured simultaneously with the piezoelectric cable and using the same techniques, which means that it can be manufactured more economically.

A further object of the invention is to provide a simple and low-cost installation method which is insensitive to climatic conditions.

In accordance with the invention, this method is characterized in that a groove is formed in the upper surface of a road, which groove has a depth which is substantially equal to the outside diameter of the tube and a transverse dimension which is slightly larger than said diameter, and in that the device is fixed in the groove by mechanical means.

An embodiment of this method is characterized in that the mechanical means comprise wedge members resting on upper part of the tube accommodated in the groove, which wedge members are arranged between the tube and the vertical walls of the groove and are fixed to the road by screws.

The advantage of this method is that it is easy to carry out. The dimensions of the groove are not restricted to narrow limits. The means used for carrying out the method are familiar to mechanics and not to specialists in the field of synthetic resins. The installation requires considerably less time; the formation of the groove and the bonding of the known device took 6 to 8 hours, whereas according to the inventive method it takes at most 3 hours to form a groove and fix the device by the wedge members. If necessary, the device can be easily removed. For example, if the transducer is out of order or is accidentally damaged, it can be readily exchanged. It can also be easily removed when it is desired to shift the measuring operations from a first location on the road to a second location. In this case the first groove can be filled or covered with a metal bar. The installation can be carried out anywhere and even under the most severe climatic conditions. Moreover, the measures are practically insensitive to said climatic conditions. Consequently, when the piezoelectric cable is connected to a device for processing the signal of the cable, the device can be used not only to detect passing vehicles, count their numbers and measure the speed, but also to measure the weight and detect the classification of the vehicles.

BRIEF DESCRIPTION OF THE DRAWINGS

The invention will be described in greater detail by means of the following description and with reference to the accompanying, schematic drawings, in which.

DESCRIPTION OF THE PREFERRED EMBODIMENT

Figure 1A:
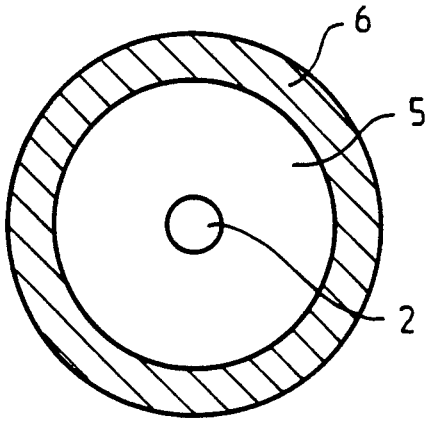
FIG. 1*a* is a cross-sectional view of a detection device according to the invention.
Figure 1B:
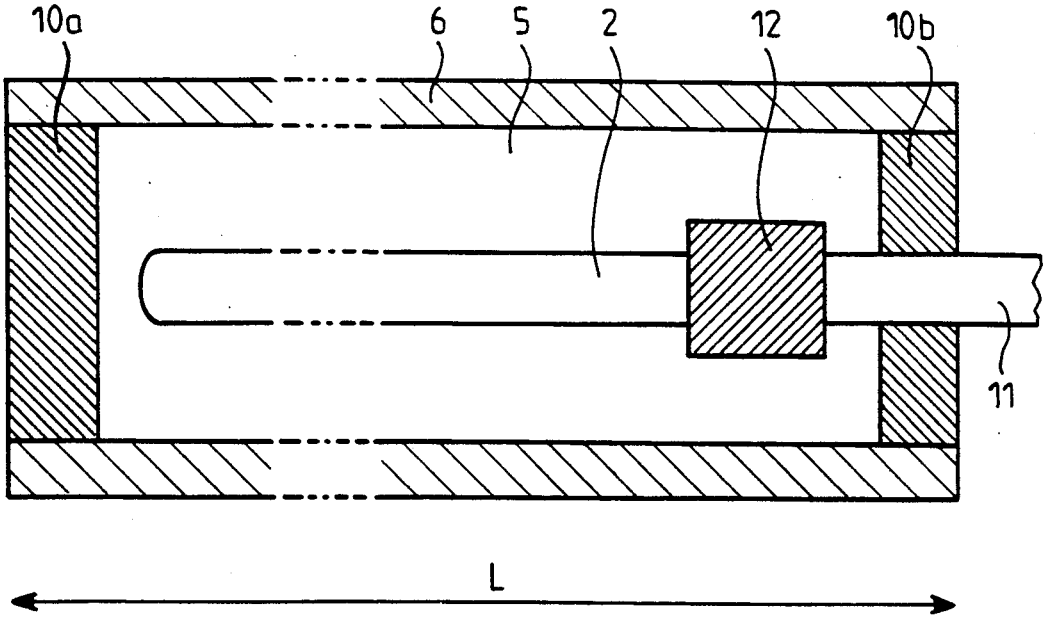
FIG. 1*b* is a longitudinal sectional view of the same device.

As shown in the cross-sectional view of FIG. 1*a*, and in the longitudinal sectional view of FIG. 1*b*, the device for detecting data relating to the passage of vehicles on a road comprises:

a piezoelectric effect cable 2 which is arranged substantially along the axis of a metal cylindrical tube 6 having an inside diameter which is larger than the outside diameter of the piezoelectric cable 2;

a filler material 5 which is provided in the space between the piezoelectric cable 2 and the inner wall of the tube 6, said material 5 being composed of a compacted metal oxide powder.

In a preferred embodiment which results from tests yielding very satisfactory results as regards measurements, ease of manufacture, resistance to the agressiveness of external agents and a long life cycle, the material selected for the manufacture of the tube 6 was a low-cost, malleable metal which cannot be degraded by oxidizing agents, such as aluminium, and for the manufacture of the filling material 5 a magnesium oxide powder or any other metal oxide powder which can be readily compressed and which satisfactorily transmits loads can be selected.

Preferably, the piezoelectric cable used is a coaxial, armoured cable 2 comprising a metal core which is insulated from a metal cladding by a ceramic material having a piezoelectric effect. A piezoelectric cable which is particularly suitable for the purpose according to the invention is a piezoelectric cable which is termed VIBRACOAX, reference 30 P1C, manufactured by Messrs. THERMOCOAX (Sursesnes-France).

As shown in FIG. 1*b*, the coaxial piezoelectric cable 2 is connected to a coaxial transmission cable 11 by a coaxial connector 12. Preferably, a cable referenced RG 58 Cu and manufactured by THERMOCOAX is used in conjunction with said piezoelectric cable VIBRACOAX.

Each end of the tube 6 is, preferably, tightly sealed by caps 10*a*, 10*b* through one of which, for example 10*b*, the transmission cable 11 is fed. The small distance separating the other, unconnected, end of the piezoelectric cable 2 from the second cap, for example 10*a*, is filled with filler material 5.

It the metal tube 6 consists of aluminium, the caps are preferably also made of aluminium.

The detection device thus obtained is rigid and tight and loads are very well transmitted to the piezoelectric cable. Moreover, the detection device has a great mechanical resistance and enables the recording of electric signals originating from the cable whose properties are practically totally independent of hot, cold, moderate or moist climatic conditions.

The manufacturing process of the data-detecting device and the piezoelectric cable itself are carried out simultaneously. If the cable in question is a VIBRACOAX cable, said cable and its manufacturing process are described in French Patent Specification FR 2 109 176.

A considerable advantage for the industrial manufacture is obtained by the fact that the cable and the detection device can both be manufactured by a method employing the same techniques and engaging the same persons skilled in the art. In this manner a considerable cost reduction is obtained, all the more because the starting materials or starting products used in the process also have a lower cost price.

The method of manufacturing the detecting device comprises the manufacture of a metal tube 6, also termed blank, of a malleable material, aluminium having very suitable properties, the diameter of the tube being larger than the diameter of the finished device; the positioning of the cable 2 with connector 12 and connecting cable 11; the filling with filler material 5, for example magnesium oxide MgO, to 70% of the theoretical density; the reduction of the diameter of the tube 6 by any techniques known to those skilled in the art such as hammering or rolling, until a device is obtained comprising a perfectly rigid tube 6 having a reduced diameter; and, finally, the mounting of the sealing caps 10*a*, 10*b*.

Figure 2:
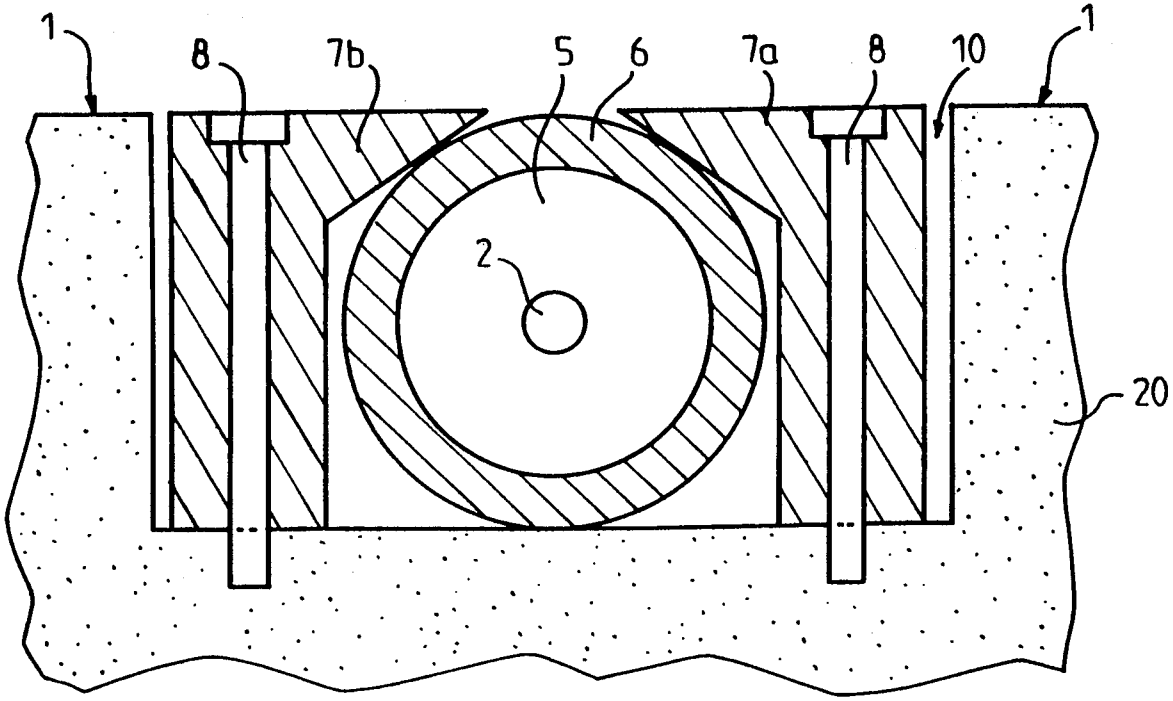
FIG. 2 shows such a device installed in the upper surface of a road.

To measure data relating to the passage of vehicles, the device is positioned in the upper part of the road surface. A method of installing the device in such a manner that a satisfactory transmission of the loads produced by passing vehicles is obtained, independent of climatic conditions, comprises the following operations, the result of which is shown in FIG. 2:

the formation of a groove 10 in the upper part of the road surface 20. The depth of said groove should be of the order of the outside diameter of the tube 6 of the detection device and its transverse dimension should be slightly larger; the groove 10 may have a rectangular cross-section, the installation of the detection device; the connecting cable 11 being directed to the locations where is will be connected with apparatus or devices for measuring and processing the electric signal originating from the piezoelectric cable 2; the detection device is installed in such a manner that the tube 6 rests on the bottom of the groove 10; thus, the upper part of the tube 6 is tangential to the upper surface 1 of the road 20, the mounting of the wedge members 7*a*, 7*b* which rest on the upper part of the tube 6 to hold it to the bottom of the groove 10, said wedge members further being arranged between the tube 6 and the vertical walls of the groove 10, the fixation of the wedge members *7a, 7b* to the road 20, for example, by means of screws passing through the wedge members and penetrating into the road.

A certain number of wedge members are mounted as described above to mechanically fix the detection device in the groove 10. The number of wedge members depends on the length L of the device (see FIG. 1*b*). The length of the device may range from 0.2 m to 4 m. In fact there are no limitations as regards the length. Said dimensions are the most likely to be used in the near future, but are only given by way of example.

When the device according to the invention is connected to a suitable electronic data processing system, as known to those skilled in the art of electronics or informatics, which system does not form part of the invention, the device according to the invention can be used for:

detecting passing vehicles,
counting,
measuring speeds,
measuring the weight of moving vehicles,
classifying said vehicles.

The armoured, piezoelectric ceramic cable 2 and the device 5, 6 surrounding it are not sensitive to climatic effects and enable the detection of electric signals which provide more information about passing vehicles than the known devices comprising synthetic resin materials.

We claim:

1. An installation of a device for detecting data relating to the passage of vehicles on a road, said installation including a groove formed in the upper surface of the road, a device comprising a piezoelectric cable and means making said cable rigid and transmitting loads produced by passing vehicles to said cable, characterized in that the means comprises a cylindrical metal tube having an inside diameter which is larger than the outside diameter of the piezoelectric cable which is arranged along the axis of the tube, the space between the cable and the inner walls of the tube being filled with a compact metal oxide powder, said groove in said road having a depth which is substantially equal to the outside diameter of said tube and a transverse dimension which is slightly larger than said outside diameter, and a mechanical means for fixing said device in said groove so that the upper surface of the device is flush with the upper surface of said road, wherein said mechanical means includes wedge members resting on the upper part of the tube which is arranged in the groove, said wedge members being arranged between the tube and the vertical walls of the groove and being fixed to the road by screws.

2. A device as claimed in claim 1, characterized in that the metal used to form the tube is aluminium (Al), and in that the metal oxide powder is a magnesium oxide powder (MgO).

3. A device as claimed in claim 1, characterized in that the piezoelectric cable is electrically connected to a coaxial connecting cable by a coaxial connector, which connecting cable is capable of being connected at its other end to equipment for recording and processing the electric data of the piezoelectric cable.

4. A device as claimed in claim 3, characterized in that the metal tube is provided with sealing caps at its ends, the connecting cable being fed through one of said caps.

5. A device as claimed in claim 4, characterized in that the longitudinal dimension of said device ranges from 0.2 m up to and including 4 m.

6. A device as claimed in claim 5, characterized in that the piezoelectric cable is of a type comprising a metal core, a metal cladding and a piezoelectric ceramic material which is densely provided between the core and the cladding.

* * * * *